US009889329B2

(12) United States Patent
Ernst

(10) Patent No.: US 9,889,329 B2
(45) Date of Patent: Feb. 13, 2018

(54) BARBELL WITH RECIPROCATING WEIGHT SLEEVES

(71) Applicant: Samuel L Ernst, Chelan, WA (US)

(72) Inventor: Samuel L Ernst, Chelan, WA (US)

( * ) Notice: Subject to any disclaimer, the term of this patent is extended or adjusted under 35 U.S.C. 154(b) by 0 days.

(21) Appl. No.: 15/128,296

(22) PCT Filed: Mar. 25, 2015

(86) PCT No.: PCT/US2015/022437

§ 371 (c)(1),
(2) Date: Sep. 22, 2016

(87) PCT Pub. No.: WO2015/148633

PCT Pub. Date: Oct. 1, 2015

(65) Prior Publication Data

US 2017/0319894 A1 Nov. 9, 2017

(51) Int. Cl.

| | |
|---|---|
| ***A63B 21/072*** | (2006.01) |
| ***A63B 21/00*** | (2006.01) |
| ***A63B 21/055*** | (2006.01) |
| ***A63B 23/12*** | (2006.01) |

(52) U.S. Cl.

CPC ..... *A63B 21/0724* (2013.01); *A63B 21/0004* (2013.01); *A63B 21/055* (2013.01); *A63B 21/4049* (2015.10); *A63B 23/1236* (2013.01)

(58) Field of Classification Search

None

See application file for complete search history.

(56) References Cited

U.S. PATENT DOCUMENTS

| | | | | |
|---|---|---|---|---|
| 818,242 | A | 4/1906 | Geisel | |
| 1,308,259 | A | 7/1919 | Sandow | |
| 1,956,498 | A | 4/1934 | Duke | |
| 3,544,106 | A | 12/1970 | Barrett | |
| 3,761,083 | A * | 9/1973 | Buchner | A63B 21/05 482/126 |
| 3,938,803 | A * | 2/1976 | Wilmoth | A63B 21/05 482/127 |
| 3,971,255 | A | 7/1976 | Varney et al. | |
| 4,978,122 | A * | 12/1990 | Dibowski | A63B 21/0724 482/106 |
| 5,152,731 | A * | 10/1992 | Troutman | A63B 21/0724 482/106 |
| 7,056,268 | B2 | 6/2006 | Emick | |

(Continued)

*Primary Examiner* — Stephen R Crow

(74) *Attorney, Agent, or Firm* — Dean Craine; Marisa Whitaker

(57) ABSTRACT

A free weight barbell with an elongated bar with two rotating weight sleeves and with axially moveable hand grips mounted on the bar located inside the weight sleeves. Each hand grip is attached to the distal end of an elongated rack that extends centrally and longitudinally inside the barbell. The inside ends of the two racks extend to or slightly beyond the bar's center axis. The bar is circular in cross-section and made of solid material with two axially aligned channels formed on opposite sides. The two channels extend from the ends of the lifting bar to a center adapter located over the bar's center axis. The hand grips slide over the ends of the bar and the two racks are inserted into the two opposite channels. The two hand grips and the two racks are coupled to a disc gear that controls the resistance forces exerted on the sliding racks.

5 Claims, 5 Drawing Sheets

(56) References Cited

U.S. PATENT DOCUMENTS

| | | | | |
|---|---|---|---|---|
| 7,794,377 | B2 * | 9/2010 | Amzallag | A63B 21/0724 482/104 |
| 9,254,408 | B1 * | 2/2016 | Otto | A63B 21/055 |
| 9,522,298 | B2 * | 12/2016 | Siemer | A63B 21/4045 |
| 9,724,560 | B2 * | 8/2017 | Murray | A63B 21/0724 |
| 2014/0045660 | A1 | 2/2014 | Murray et al. | |

* cited by examiner

BARBELL WITH RECIPROCATING WEIGHT SLEEVES

Notice is given that the following patent document contains original material subject to copyright protection. The copyright owner has no objection to the facsimile or digital download reproduction of all or part of the patent document, but otherwise reserves all copyrights.

TECHNICAL FIELD

The present invention pertains to exercise equipment, and more particularly, to barbells designed to target specific chest muscles.

BACKGROUND ART

It is well known that lifting weights causes microscopic tears in muscle tissues and that the body quickly responds by rebuilding and adding new tissues to the muscle. It is also well known that if improper lifting techniques are used, the muscles, ligaments, and tendons can also be strained or torn. If the damage is severe, it can take several weeks or months to recover.

Many weight lifting exercises require the use of a barbell that is a solid bar made of steel between 4 to 8 feet in length and 1 to 2 inches in diameter. Identical disc weights are slid onto the opposite ends of the barbell to provide the desired total weight needed for the exercise. End collars are attached to the ends of the barbell to hold the disc weights on the ends of the barbell. The central portion of the barbell often includes knurled crosshatching to improve the weight lifter's grip on the barbell.

Experienced weight lifters know the location and orientation of the muscles groups on different parts of the body and which exercises they should use to strengthen these specific muscle groups. For example, the main chest muscle that extends across the front of the chest from the sternum to the humerus is the pectoralis major muscle. An important muscle that extends diagonally across the front of the chest and partially under the pectoralis major and connects the middle front rib to the scapula is the pectoralis minor muscle. The size and shape of both muscles play an important role on the overall appearance of the chest. Because of their locations and orientations on the chest, however, lifting exercises that use a standard barbell to target these muscles are not known to the inventor.

What is needed is a barbell used to lift weights that targets the pectoralis major and pectoralis minor muscles and leads to faster and greater hyperplasia.

DISCLOSURE OF THE INVENTION

It is an object of the invention to provide a barbell used with weight lifting exercises that targets the pectoralis major and minor muscles and leads to faster and greater hyperplasia.

A key discovery is that stressing the pectoralis major and minor muscles simultaneously in two directions when performing lifting exercises, creates greater muscle damage to the pectoralis major muscle and the pectoralis minor muscle and leads to faster repair and rebuilding.

It is another object of the present invention to provide a free weight barbell with rotating weight sleeves with axially moveable hand grips mounted on the barbell located inside the weight sleeves.

Each hand grip is attached to the distal end of an elongated rack that extends centrally and longitudinally inside the barbell up to or slightly beyond the lifting bar's center axis. The barbell includes an elongated bar circular in cross-section and made of solid material with two axially aligned channels on opposite top and bottom surfaces which extend from the bar's opposite ends to a central adapter attached at the center axis of the elongated bar. The hand grips slide over the ends of the elongated bar and the two racks are inserted into the two opposite channels. The hand grip and the rack on each end of the bar are coupled together and slide back and forth as a single unit over the elongated bar.

Each rack includes a plurality of teeth formed on its inside surface that mesh with teeth formed on a disc gear in the center adapter. The teeth on the two racks mesh with teeth on opposite sides of the disc gear which allows the two racks to travel longitudinally in the same distances on opposite sides of the bar. In one embodiment, the disc gear is attached to the elongated bar with a threaded connector that includes a flat braking washer. During use, the user may tighten or loosen the threaded connector to adjust the pressure exerted by the braking washer against the disc gear to control the resistance of the two racks in the two channels.

An important benefit of the above described barbell is that the user may simultaneously slide his or her hands longitudinally over the elongated bar as the bar is manipulated. Because the two hand grips are coupled together, lateral forces exerted on the two hand grips are shared. Resistance force exerted on one hand grip is automatically shared with the opposite hand grip allowing the user to not only maintain control of the barbell, but also apply the same lateral force.

BEST MODE FOR CARRYING OUT THE INVENTION

Figure 1:
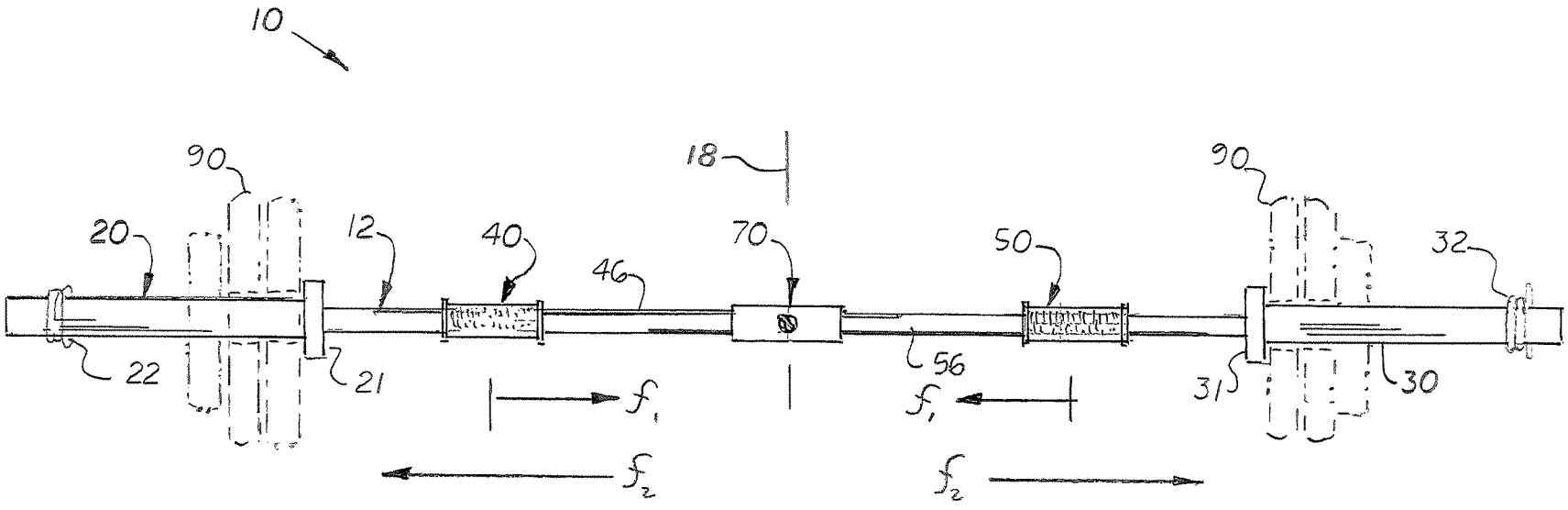
FIG. 1 is a side elevational view of the targeting chest muscles barbell
Figure 2:
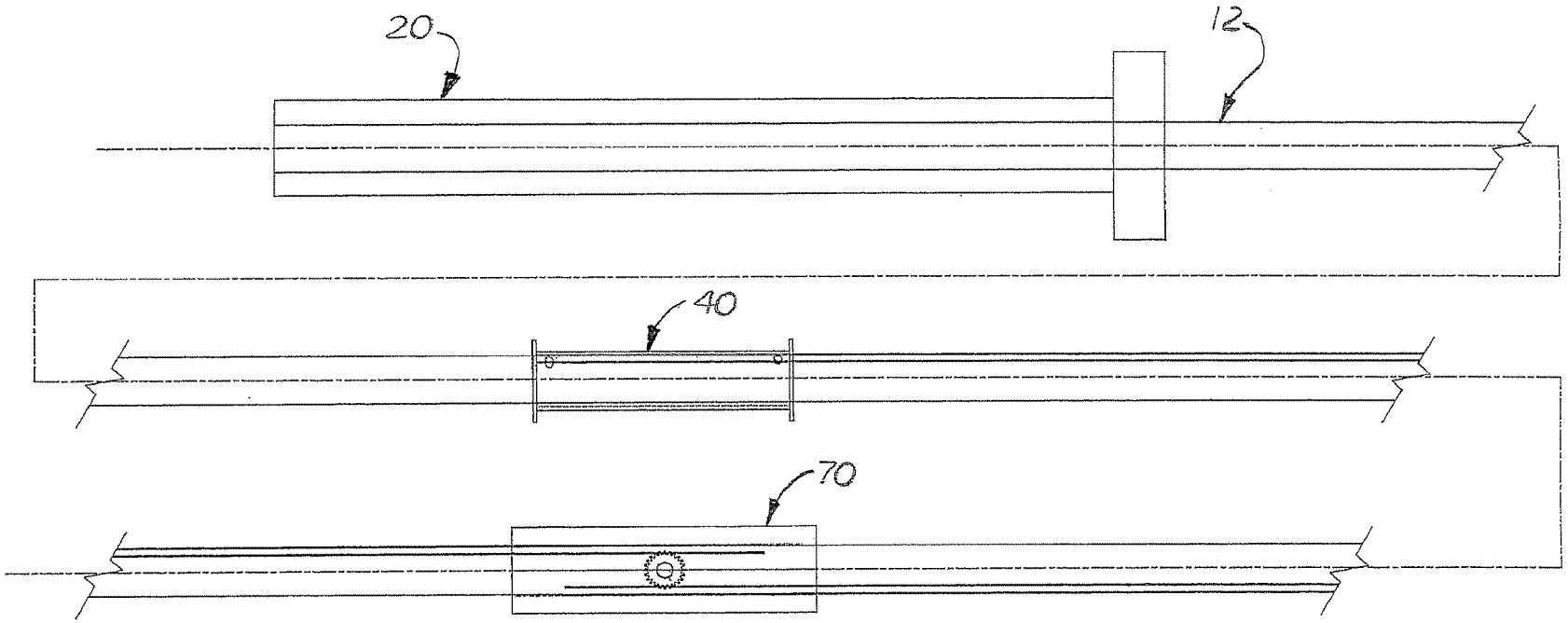
FIG. 2 is an enlarged, exploded side elevational view of the barbell shown in FIG. 1.

In the accompanying Figs, there is shown free weight barbell 10 with an elongated bar 12 with rotating weight sleeves 20, 30 mounted on each end and with axially moveable hand grips 40, 50 located inside the two weight sleeves 20, 30, respectively. At the center axis 18 of the elongated bar 12 is a central adapter 70 that controls and couples together the longitudinally movement of the two hand grips 40, 50 over the bar 12.

The weight sleeves 20, 30 are t-shaped, cylindrical structures with perpendicular aligned flanges 21, 31, respectively. During use, disc weights 90 are placed on the weight sleeves 20, 30 and forced against the flanges 21, 31, respectively. Lock rings 22, 32 are attached to the weight sleeves 20, 30, respectively, which are forced inward to hold the disc weights 90 in place against the flanges 21, 31.

Each hand grip 40, 50 is a hollow cylindrical structure that slides longitudinally over the section of the 12 that extends from the flanges 21, 31 to the bar's center axis 18. Each hand grip 40, 50 is attached to an elongated rack 46, 56, respectively. The elongated racks 46, 56 fit into recessed channels 14, 16 formed on the bar's top surface 13 and bottom surface 15, respectively. The channels 14 and 16 are parallel to the bar's longitudinal axis 19 and extend from the weight sleeve 20, 30 to a distance slightly beyond the bar's center axis 18. The channels 14, 16 are sufficient in depth so that the top surfaces of the racks 46, 56 are substantially even or flush with the top surface 13 and bottom surface of the bar 12. The proximal end of each rack 46, 56 is securely attached to the inside surface of the hand grip 40, 50, respectively, so that each hand grip 40, 50 and its rack 46, 56, respectively, move longitudinally as a unit over the bar 12.

Figure 3:
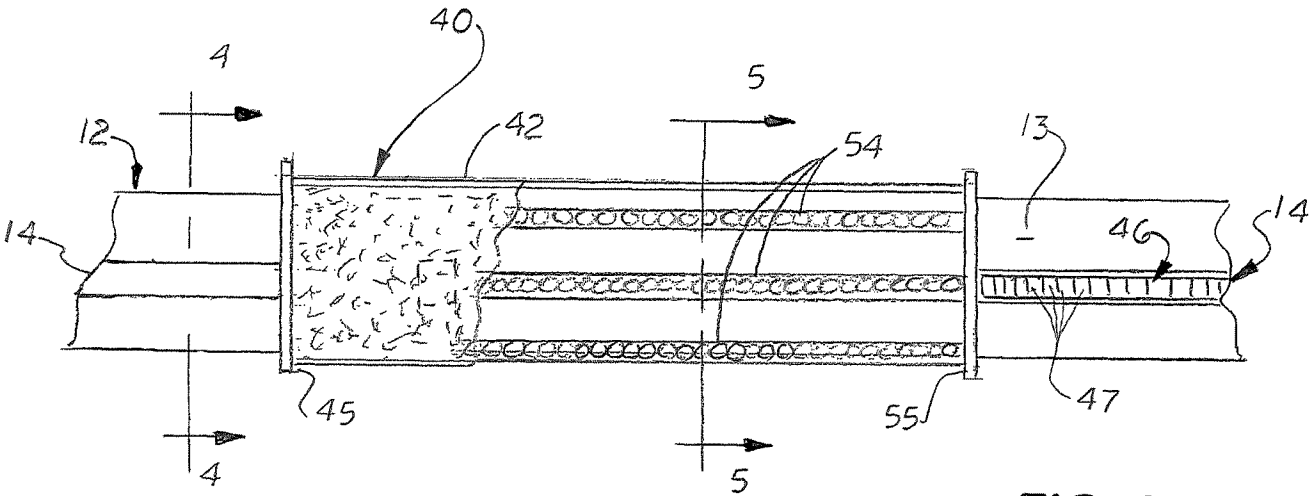
FIG. 3 is a partial, sectional view of a sliding hand grip mounted on the barbell.
Figure 5:
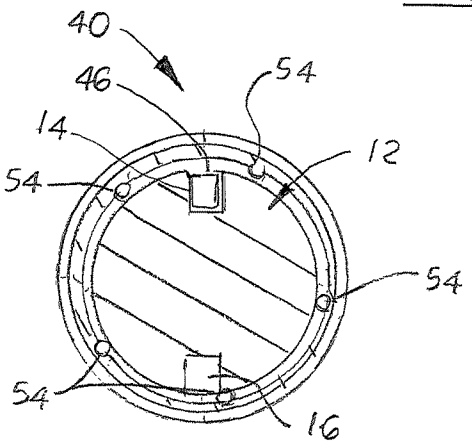
FIG. 5 is a sectional end elevational view of the hand grip taken along line 5-5 in FIG. 3.
Figure 4:
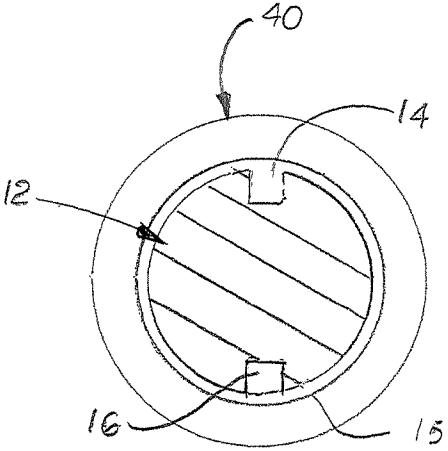
FIG. 4 is a sectional end elevational view of the hand grip taken along line 4-4 in FIG. 3.
Figure 6:
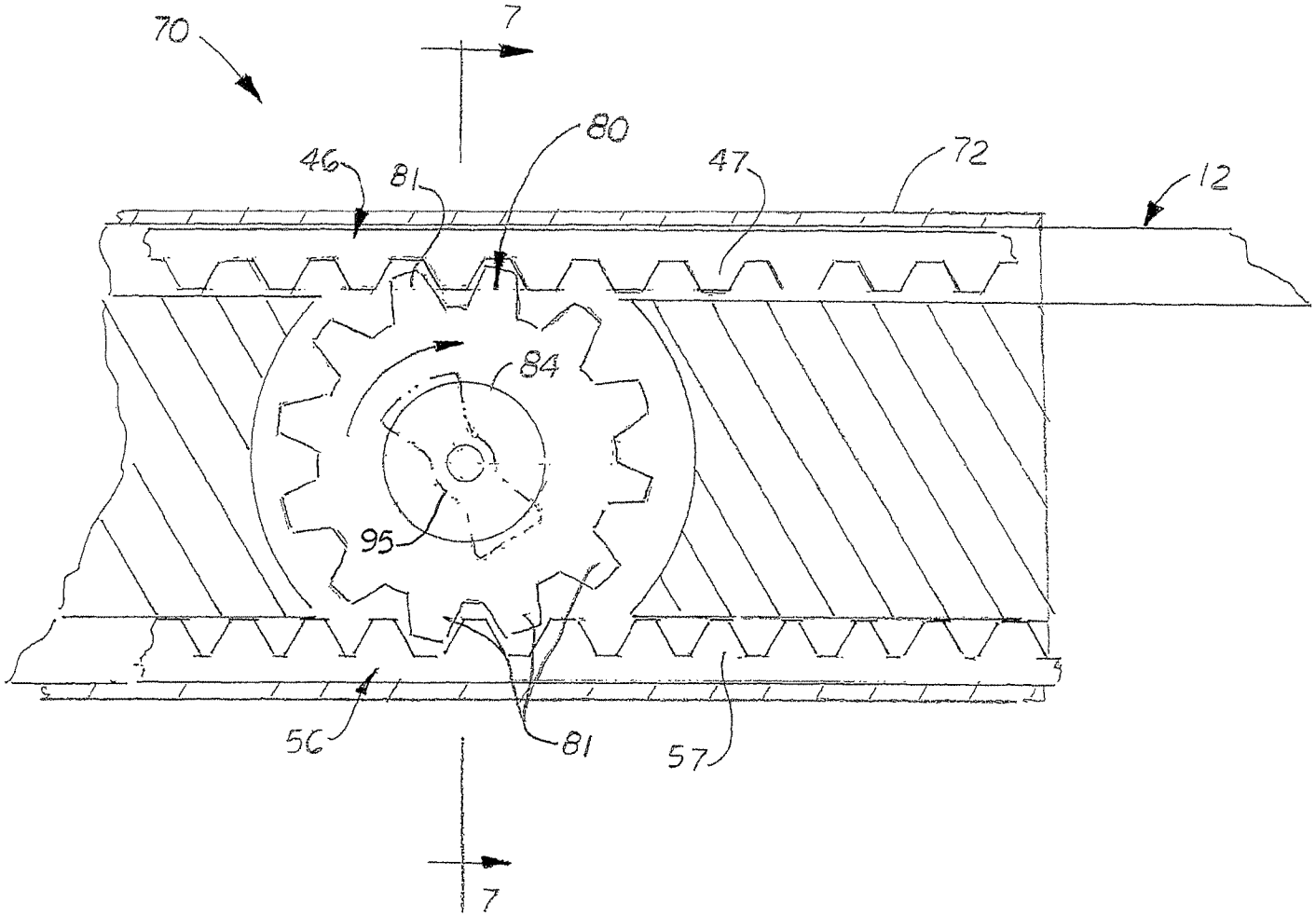
FIG. 6 is a partial, sectional view of the central adapter showing the coupler attached to the barbell and showing the two racks meshing with the gear on opposite sides.
Figure 7:
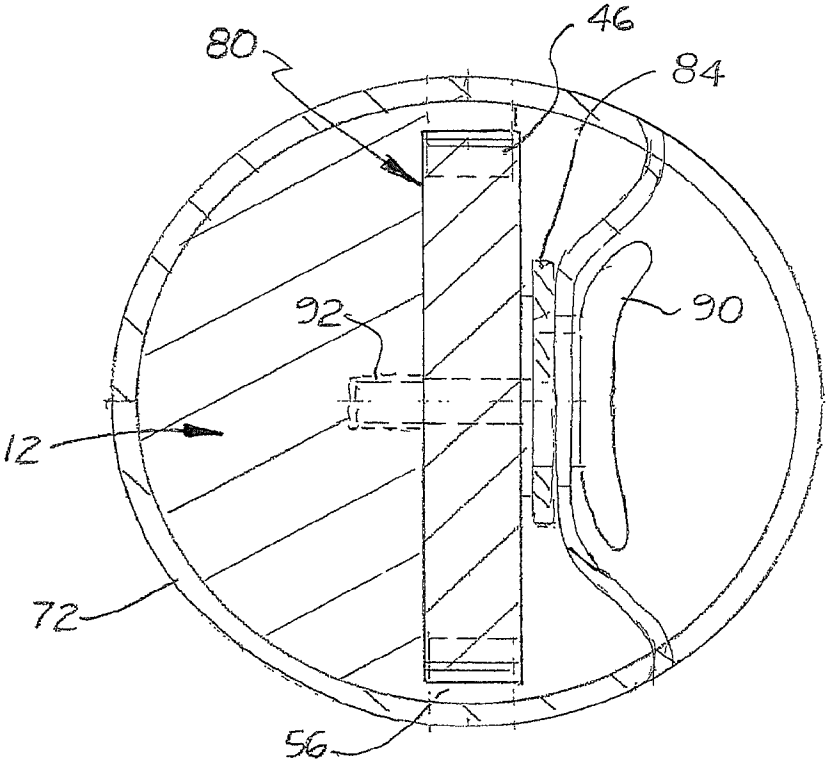
FIG. 7 is a sectional end elevational view of the central region of the barbell shown along line 7-7 in FIG. 6.

As shown more clearly in FIG. 3, each hand grip (only one hand grip 40 is shown) includes a cylindrical linear bearing 42 containing a plurality ball bearings 5 spaced evenly and radially apart. Formed on the opposite ends of each hand grip 40, 50 may include optional end flanges 45, 55, respectively. Each rack (only rack 46 shown in FIG. 3) includes a plurality of teeth 47 formed on its outside surface that mesh with compatible gear teeth 81 formed on a rotating disc gear 80 in the center adaptor 70 shown in FIG. 6.

The disc gear 80 as a diameter that approximately matches the space between the two racks 46, 56. Also, center area of the bar 12 includes a center recess area sufficient in size to accommodate the disc gear 80. In one embodiment, the disc gear 80 is attached to the elongated bar 12 with a threaded connector 95 hat includes a flat braking washer 84. During use, the user may tighten or loosen the threaded connector 95 to adjust the pressure exerted by the braking washer 84 against the outside surface of the disc gear 80 to decrease or increase the rotational resistance of the disc gear 80 on the elongated bar 12. By controlling the rotational resistance of the disc gear 80, the user can control the sliding resistance of the two racks 46, 56 in the two channels 14, 16, respectively.

As stated above, the barbell 10 may be used in a normal manner to lift weights. When vertically lifting, the user may simultaneously slide the two hand grips 40, 50 longitudinally and in opposite directions over the bar 12. Because the two hand grips 40, 50 are coupled to the disc gear 80, the lateral forces exerted on the two hand grips 40, 50 are shared. Resistance force exerted on one hand grip is automatically shared with the opposite hand grip allowing the user to not only maintain control of the bar 12, but also apply the same lateral forces to each hand grip 40, 50. The lifting motion and the inward and outward movement of the hand grips 40, 50 over the bar 12 allows the user to exercise both the pectoralis major muscle and the pectoralis minor muscle.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

INDUSTRIAL APPLICABILITY

This invention has application in the exercise industry. More specifically, to the weight lifting exercise industry.

I claim:

1. A free weight barbell, comprising;

a. an elongated solid bar with two opposite ends, a top surface, a bottom surface, a center axis, a center recess area located at the center axis, and two axially aligned channels formed on opposites sides of the bar that extend to the center axis;

b. a pair of weight sleeves located on the opposite ends of the bar;

c. a pair of sliding hand grips mounted on the opposite ends of the bar and located adjacent to and inside the weight sleeves, each hand grip includes an inside linear bearing having longitudinally aligned ball bearings configured to enable the hand grip to slide longitudinally freely over the bar, each hand grip includes a longitudinally aligned rack that fits inside one channel formed on the opposite sides of the bar, each rack is sufficient in length to extend from an end of the bar to at least to the center axis of the bar, each rack includes one surface with a plurality of inward extending teeth; and c. a rotating disc gear located at or near the center axis of the bar, the disc includes a plurality of teeth formed on its perimeter configured to simultaneously mesh with teeth on each rack, wherein when the hand grips move simultaneously longitudinally in opposite directions over the bar, the disc gear rotates in one direction so that the two handles travel the same distances over the bar.

2. The barbell, as recited in claim 1, wherein the hand grips rotate over the bar.

3. The barbell, as recited in claim 1 further including a tension adjustment mechanism coupled to the disc gear that enables a user to adjust the rotational resistance of the disc gear.

4. The barbell, as recited in claim 2 further including a tension adjustment mechanism coupled to the disc gear that enables a user to adjust the rotational resistance of the disc gear.

5. A method for simultaneously exercising the pectoralis major muscle and the pectoralis minor muscle, comprising the following steps:

a. selecting a barbell that includes:

an elongated solid bar with two opposite ends, a top surface, a bottom surface, a center axis, and two axially aligned channels formed on opposites sides of the bar that extend to the center axis;

a pair of weight sleeves attached to the opposite ends of the bar;

a pair sliding hand grips mounted on the opposite sides of the bar and located inside the weight sleeves, each hand grip includes an internal linear bearing configured to slide longitudinally freely over the bar, each hand grip is attached to a longitudinally aligned narrow rack that fits inside one of the channels formed on the opposite sides of the bar when the hand grips are attached to the bar, each rack is sufficient in length to extend at least to the center axis of the bar and includes a plurality of outward extending teeth;

a rotating disc gear located at or near the center axis of the bar, the disc gear includes a plurality of teeth formed on its perimeter and the disc gear is configured and oriented on the bar so that teeth on opposite sides of the disc gear mesh with the teeth on the two the racks, wherein when the hand grips move simultaneously longitudinally in opposite directions over the bar, the disc gear rotates so that the two handles travel the same distances over the bar;

b. attached two equal size weight stacks to each end of the bar desired to exercise the pectoralis major muscle and the pectoralis minor muscle; and c. gripping the hand grips and simultaneously and repeatingly lifting and moving the hand grips over the bar.

* * * * *